US006213886B1

(12) United States Patent
Johnston

(10) Patent No.: US 6,213,886 B1
(45) Date of Patent: Apr. 10, 2001

(54) BOWLING GAME

(76) Inventor: Bernie Johnston, R.R. #3, Fort Saskatchewan, Alberta (CA), T8L 2N9

( * ) Notice: Subject to any disclaimer, the term of this patent is extended or adjusted under 35 U.S.C. 154(b) by 0 days.

(21) Appl. No.: 09/129,090

(22) Filed: Aug. 5, 1998

(51) Int. Cl.[7] ..... A63D 5/09
(52) U.S. Cl. ..... 473/78; 473/81; 473/116
(58) Field of Search ..... 473/68, 78, 79, 473/80, 81, 116

(56) References Cited

U.S. PATENT DOCUMENTS

| | | | | |
|---|---|---|---|---|
| 700,614 | * | 5/1902 | Butts | 473/81 |
| 784,360 | * | 3/1905 | Stevens | 473/78 |
| 835,554 | * | 11/1906 | Powers | 473/78 |
| 2,018,833 | * | 10/1935 | Cahill | 473/78 |
| 3,586,325 | | 6/1971 | Lorber . | |
| 3,756,598 | | 9/1973 | Maeda . | |
| 5,167,412 | | 12/1992 | Rochefort . | |
| 5,374,220 | | 12/1994 | Burtchett . | |
| 5,575,718 | | 11/1996 | Simmons . | |

* cited by examiner

*Primary Examiner*—William M. Pierce
(74) *Attorney, Agent, or Firm*—Bennett Jones LLP

(57) ABSTRACT

A novel small-scale replica bowling game is disclosed. The game is a realistic simulation of the game of either 5 pin or 10 pin bowling on an approximate 1:6 scale. The game comprises a player operated pin reset mechanism which is operable from the player end of the game as well as a gravity operated ball return mechanism.

6 Claims, 7 Drawing Sheets

BOWLING GAME

FIELD OF THE INVENTION

The present invention relates to small scale replica bowling game.

BACKGROUND OF THE INVENTION

The game of bowling a is a very popular pastime in both its 10 pin and 5 pin forms. However, because of the physical requirements of bowling lanes, it may not be played in most homes. Consequently, there have been many bowling games developed which are meant to simulate bowling and which are down-sized so that they may be enjoyed at home or in other smaller indoor spaces.

In U.S. Pat. No. 5,374,220 issued to Burtchett, there is described a portable bowling alley with a ball return mechanism. The disadvantage to this portable game is that there is no way of resetting or clearing the pins after they have been knocked down, other than walking from one end of the game to the other and resetting or clearing each pin by hand.

Therefore, there is a need in the art for a replica small scale bowling game which realistically simulates the game of bowling, permits the player to reset or clear the pins from the player end of the game and has a ball return mechanism.

SUMMARY OF THE INVENTION

In general terms, the invention comprises a small scale replica bowling game having a player end and a pin end, said game comprising;

(a) a flat lane surface abutted by a ball gutter on either side;

(b) an overhead pin housing disposed above the pin end of the lane;

(c) at least 5 bowling pins, each pin having a head and a base and each pin moveable between a lowered set position on the lane surface and a raised position above the lane surface; and (d) reset means associated with each pin wherein the reset means is operable by the player at the player end to raise and lower each pin.

The pin reset means may comprise a reset member moveable between a first and second position, a force transmittal means for communicating movement of the reset member to the pin such that when the reset member is in the first position, the pin is in the lowered position and when the reset member is in the second position, the pin is in the raised position.

In one embodiment drawn and described herein, the reset member is an elongate rod slidably engaging the underside of the lane surface and the force transmittal means is a cable attached to one end of the rod and also attached to the pin head. In an alternative embodiment, a lever is interposed between the rod and the cable to provide a mechanical advantage to the user.

The bowling game may further comprise ball return means for returning a game ball to the player end of the game. In the embodiment drawn and described herein, the ball return means is gravity-operated and comprises a ball collection ramp, a return tube and a return outlet, arranged such that the game ball is gathered by the ramp into the return tube and comes to rest in the return outlet at the player end of the game.

BRIEF DESCRIPTION OF THE DRAWINGS

FIGS. 7A and 7B depict the positions of a lever of the alternate mechanism.

DETAILED DESCRIPTION OF THE INVENTION

The preferred embodiment of the invention will now be described with reference to the Figures referred to above. The Figures and description which follows refer to a 5 pin bowling game (10). However, it is to be understood that the invention includes a 10 pin bowling game (10) and that the modifications necessary to the preferred embodiment described herein may readily be understood and carried out by a person skilled in the art.

Figure 1:
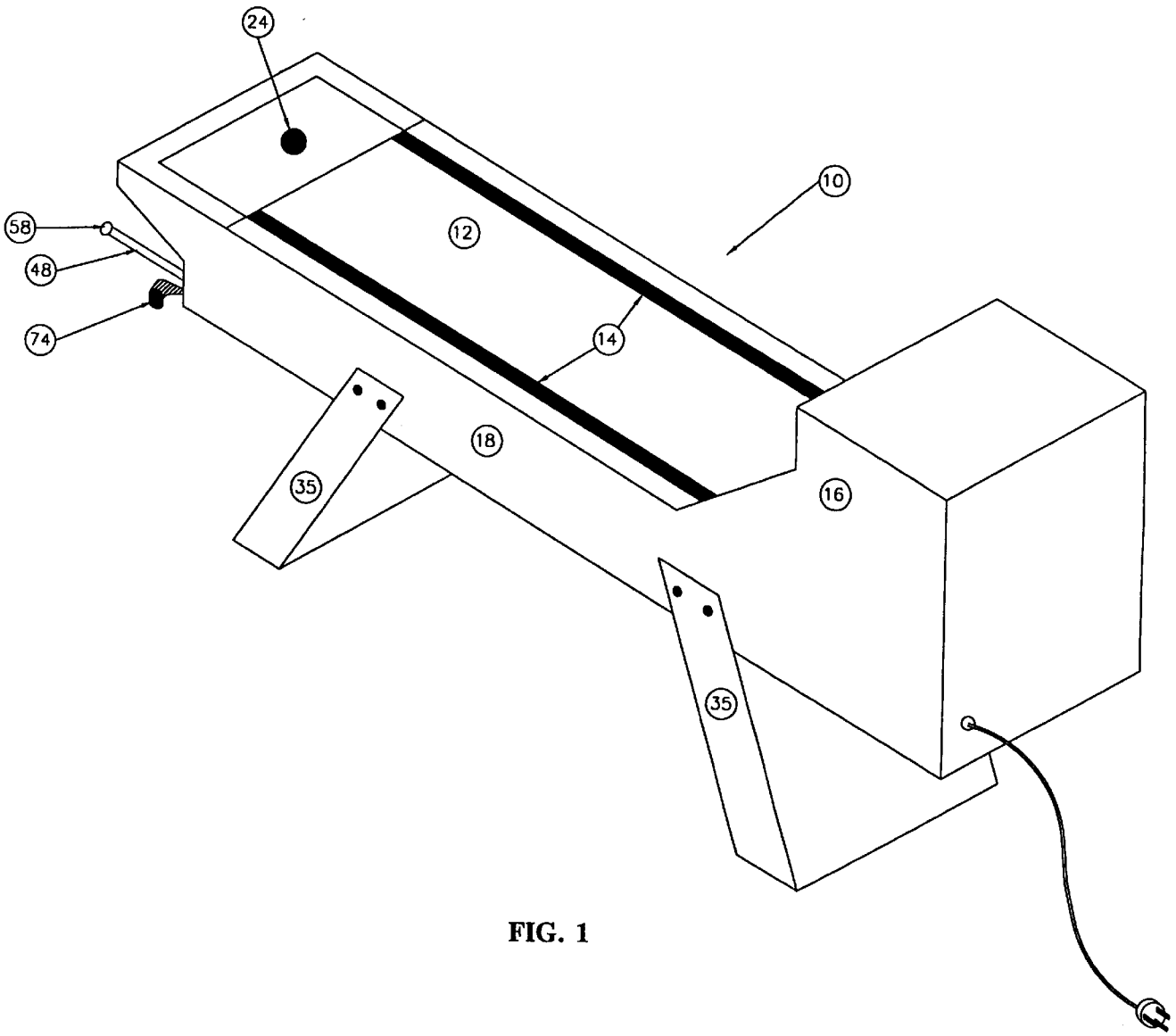
FIG. 1 is a pictorial depiction of the preferred embodiment of the present invention.
Figure 2:
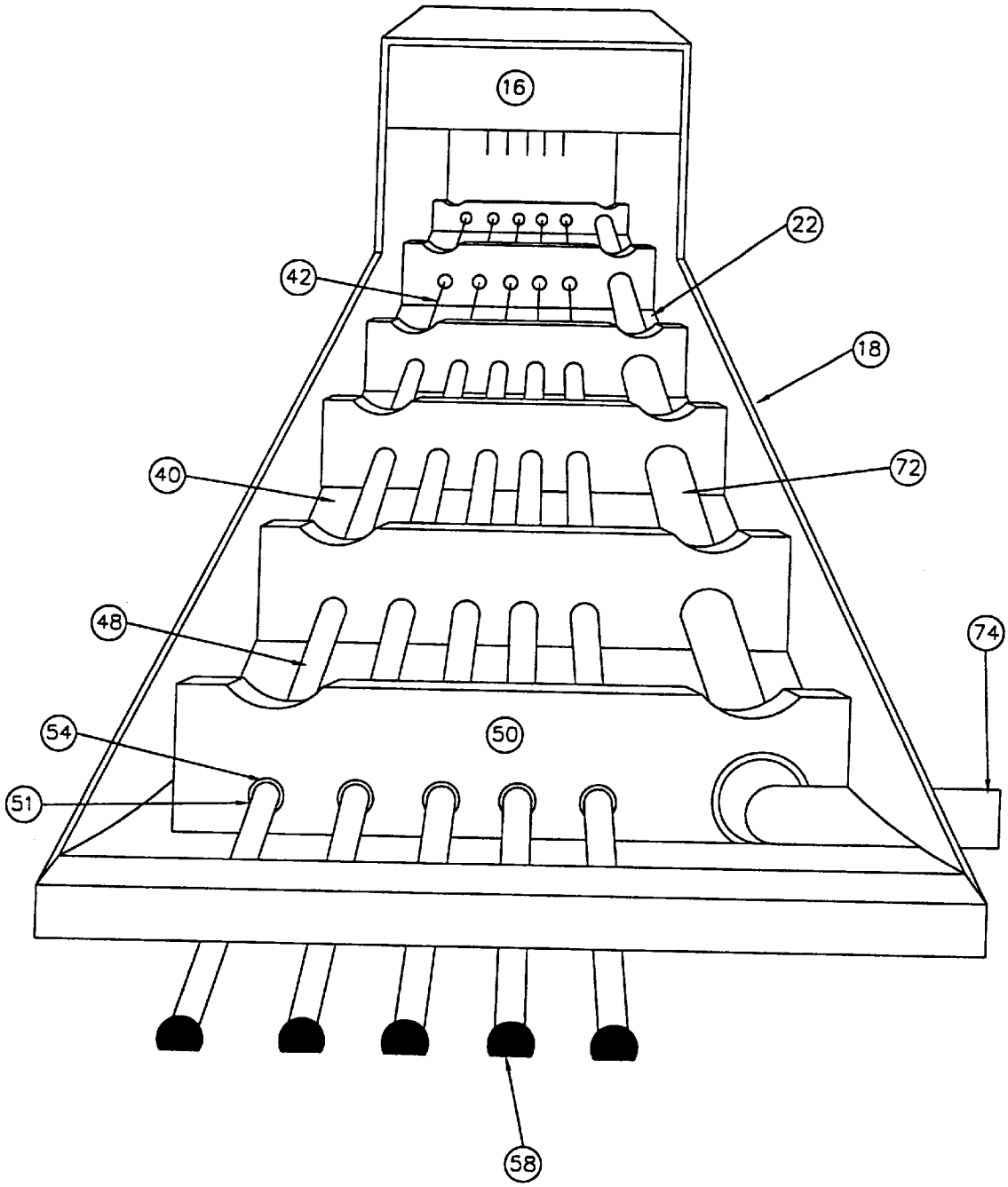
FIG. 2 is an upper perspective view of the preferred embodiment with the lane surface and ball gutters removed.
Figure 3:
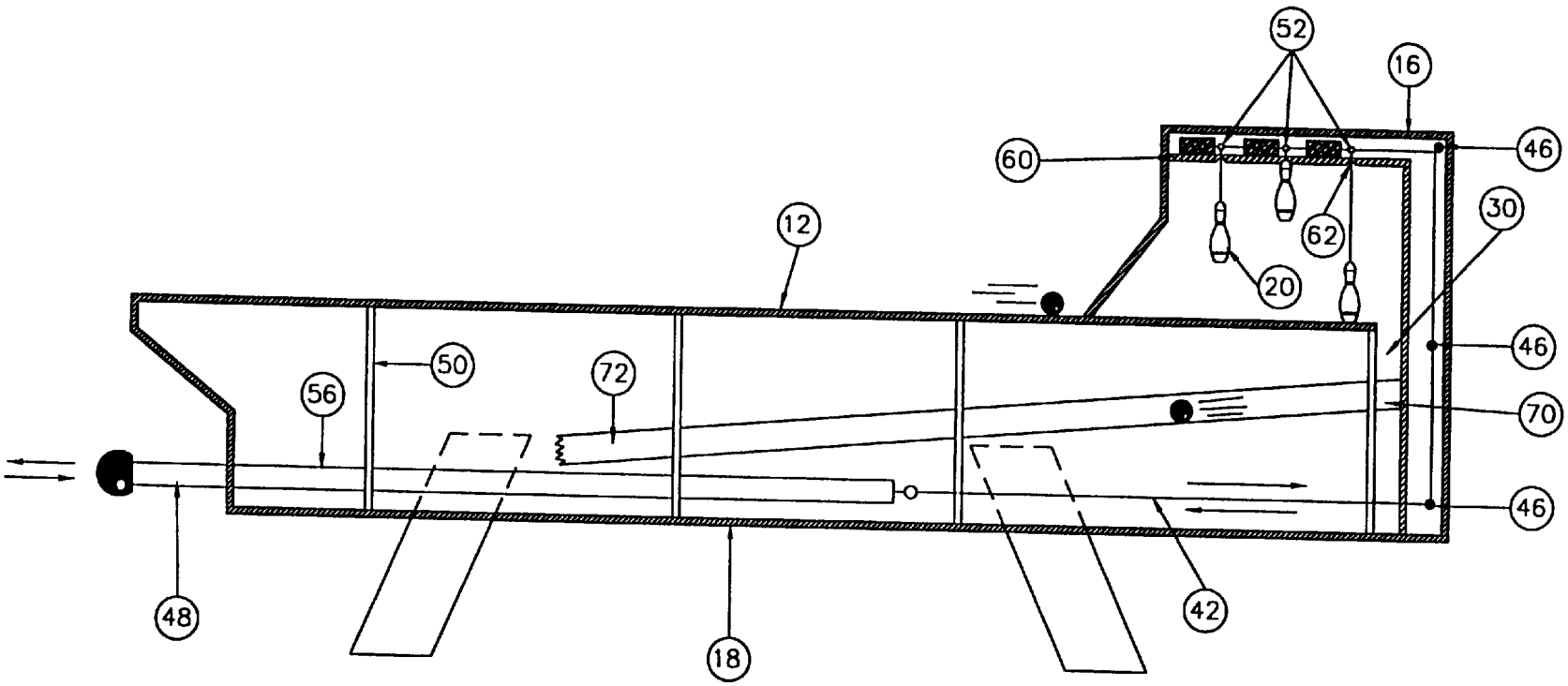
FIG. 3 is a side cross-sectional view along 3–3 in FIG. 1.
Figure 4:
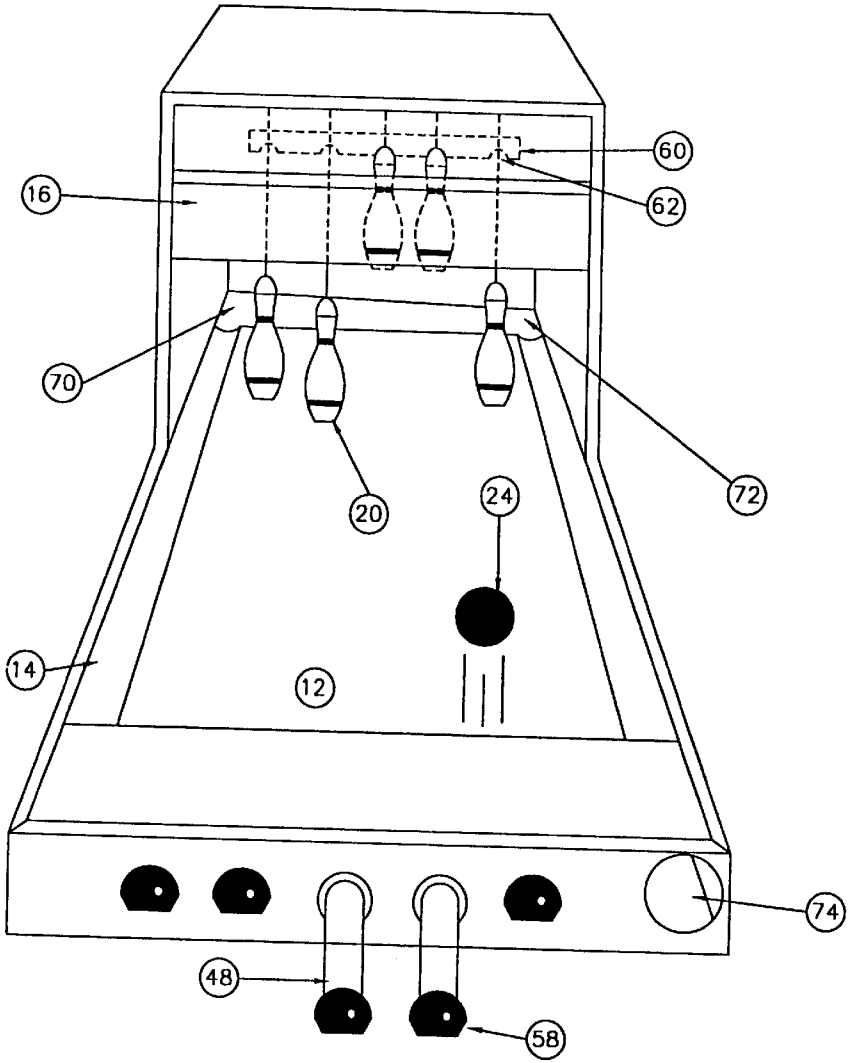
FIG. 4 is a front perspective view showing the operation of the game.
Figure 5:
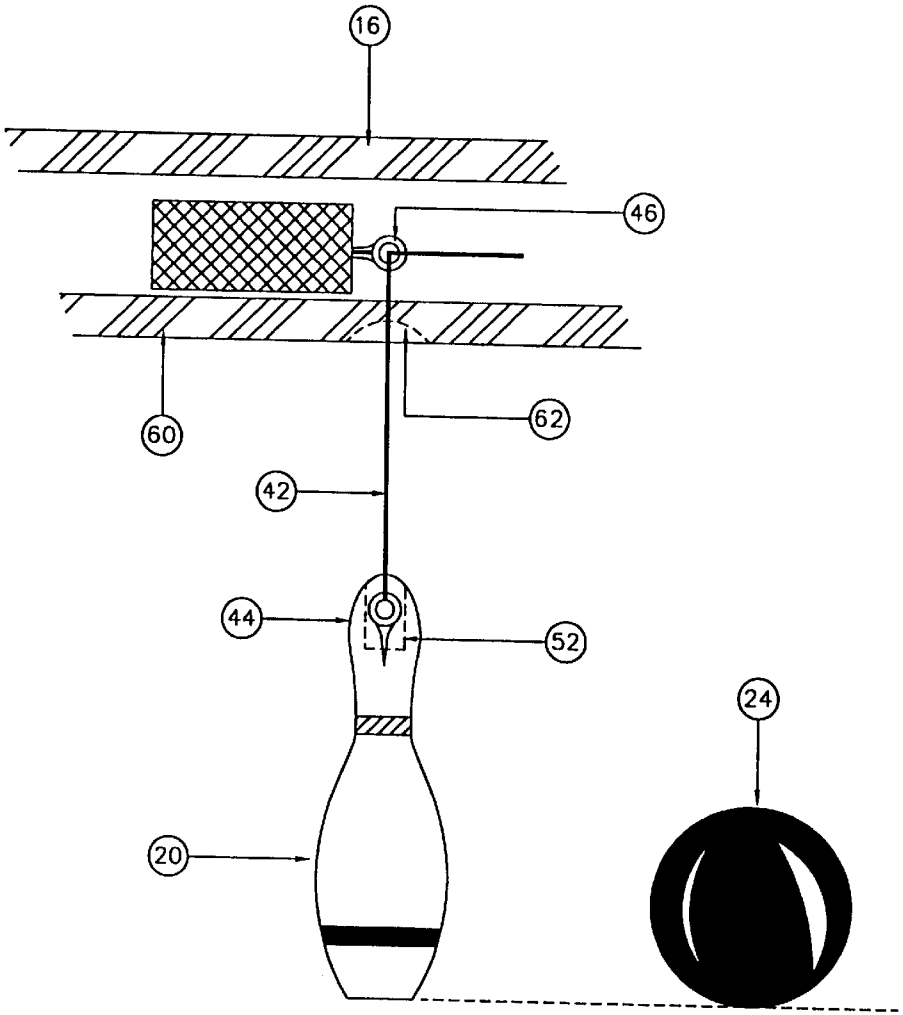
FIG. 5 is a detailed view of a pin of the game.
Figure 6:
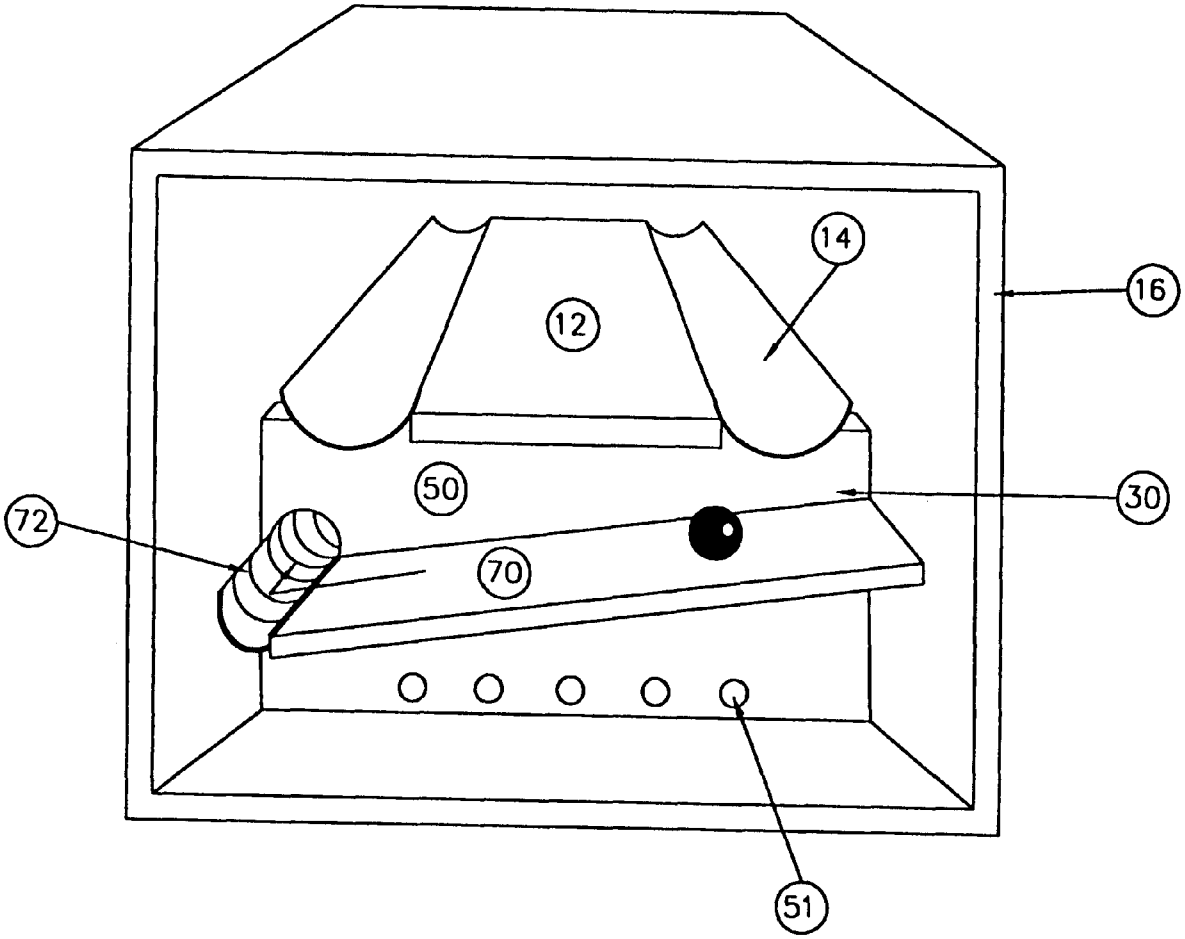
FIG. 6 is a rear cross-sectional view along 6—6 in FIG. 1.

The bowling game (10) generally comprises a lane surface (12), ball gutters (14) adjacent the lane surface (12), an overhead pin housing (16), a main housing (18), bowling pins (20) and a ball return mechanism (22), all of which are arranged so as to simulate the actual game of bowling as shown in FIG. 1. The lane surface (12) of the preferred embodiment is about 3.5 meters long and 30 cm wide, which is approximately 17% of an actual bowling lane. The other dimensions of the lane, the bowling pins (20) and the game ball (24) are chosen so as to be proportionate to the length of the lane and provide a realistic simulation of actual bowling. In the preferred embodiment, each pin (20) is approximately 13 centimeters tall and weighs approximately 50 grams. The ball (24) is approximately 4 cm in diameter and weighs approximately 160 g. The pins (20) are also positioned in a proportional realistic fashion.

While the actual dimensions and weights of these components preferably provide a realistic simulation of the game (10), they are not essential to the invention as claimed herein. Important dimensions which provide realism to the game (10) include the relative size of the pins (20), the distance between the pins (20) when they are in the set position, the width and length of the lane surface (12) and the density and size of the ball (24) used.

The lane surface (12) is somewhat shorter than the main housing (18) leaving a gap (30) at the end of the lane surface (12) through which a game ball (24) may drop once thrown down the lane (12).

The lane surface (12) is preferably raised to a level which is physically convenient to a standing player. In the preferred embodiment, the lane surface (12) is permanently supported by the main housing (18) and legs (35) which sets the lane surface (12) at an approximate height of 80 cm. Persons skilled in the art may realize that the lane surface (12) and main housing (18) may be manufactured without the legs (35), in which case it may be played at ground level or placed upon a table or the like. Also, it may be readily seen that adjusting mechanisms (not shown) may be provided to allow a player to conveniently raise or lower the lane surface (12) in the preferred embodiment.

In the preferred embodiment, the pin reset mechanism (40) for a single pin (20) comprises a pin cable (42) which is affixed to the head (44) of the pin (20), a number of cable guides (46) for guiding and redirecting the cable (42) from the pin (20), through the pin housing (16) to underneath the lane surface (12), and a push/pull dowel or rod (48) which is attached to the other end of the pin cables (42) and which also runs underneath the lane surface (12), through openings in the frame cross-members (50), which are part of the structural support for the lane surface (12). The dowel (48), when pulled out of the main housing (18), will pull the pin (20) and raise it above the lane surface (12). Obviously, when pushed back in, the dowel (48) will lower the pin (20) back to a standing position on the lane surface (12). The pin cables (42) are conveniently made from nylon monofilament in the preferred embodiment. The pin cable (42)s are attached to the pin heads (44) and the dowel (48) ends by means of countersunk eyescrews (52). The cable guides (46) may be simple eyescrews (52) through which the pin cable (42) passes through and the dowels (48) may be simple hardwood rods.

The pins (20) remain in the raised position once the dowels (48) are pulled out as a result of the inertial mass of the dowel (48) and by some friction in the dowel (48) mechanism. Rubber washers (54) are provided to cable opening (51) in the cross members (50) to cushion the movement of the dowel (48) and muffle any sound produced as the dowels (48) are pushed and pulled.

Obviously, the pin cables (42) must be of sufficient length to allow the pins (20) to be knocked over when the dowels (48) are fully pushed in. In other words, when a pin (20) is in its set position, there should be sufficient slack in the pin cable (42) to allow the pin (20) to be knocked over and knock over adjacent pins (20). However, excessive slack should be avoided as that will require excessive travel of the dowel (48) to reset the pin (20).

Each dowel (48) possesses a stop (56) which restricts movement of the dowel (48) past a certain point to prevent damage if the dowel (48) is pulled beyond the necessary range of travel. The stop (56) may be a washer or a pin (20) fixed to the dowel (48). A knob (58) attached to the end of the dowel (48) limits movement of the dowel (48) in the other (push) direction.

There is a pin retaining board (60) within the overhead pin canopy (16) which has countersunk ports (62) corresponding to each pin (20). The ports allow passage of the reset cable (42)s and also serve as pin stabilizers when the pin (20) is raised into the canopy.

There is also provided a gravity operated ball return system (22) in the preferred embodiment. Once the ball drops in the gap (30) between the lane surface (12) and the main housing (18), it falls onto a ramp (70) within the main housing (18). The ramp (70) is slanted so that the ball rolls towards one side of the main housing (18). The ball is then directed into a ball return pipe (72) which is slanted downwards towards the player end of the game (10). The ball then passes through an opening in the housing and into a ball return cup (74) which is readily accessible by the player.

Ball return systems (22) which are powered and more complex may readily be conceived of and implemented by persons skilled in the art.

The game (10) is preferably fashioned from wood products although a specific construction material is not claimed as a feature of the invention. Other non-essential items include, but are not limited to, a face plate on the front side of the pin canopy to hide the pins (20) when they are in a raised position. A fluorescent light fixture (not shown) may be provided within the pin canopy to illuminate the playing area of the lane surface (12).

The game (10) is played in accordance with the rule of bowling. The player begins by resetting all of the pins (20) by pushing all of the dowels (48) into the main housing (18) to lower the pins (20) to their set position. The player then throws a game ball (24) at the pins (20), attempting to knock them down. The player then sets up for her next shot by pulling those dowels (48) attached to the pins (20) which were knocked down. Those pins (20) are then raised out of the way into the pin housing (16).

In an alternative embodiment, the game (10) may include a microprocessor which may automatically keep track of player scores. The microprocessor could be programmed with the rules of bowling and would receive signals from each pin mechanism (40) means to determine which pins (20) were knocked down by each player.

Figure 7:
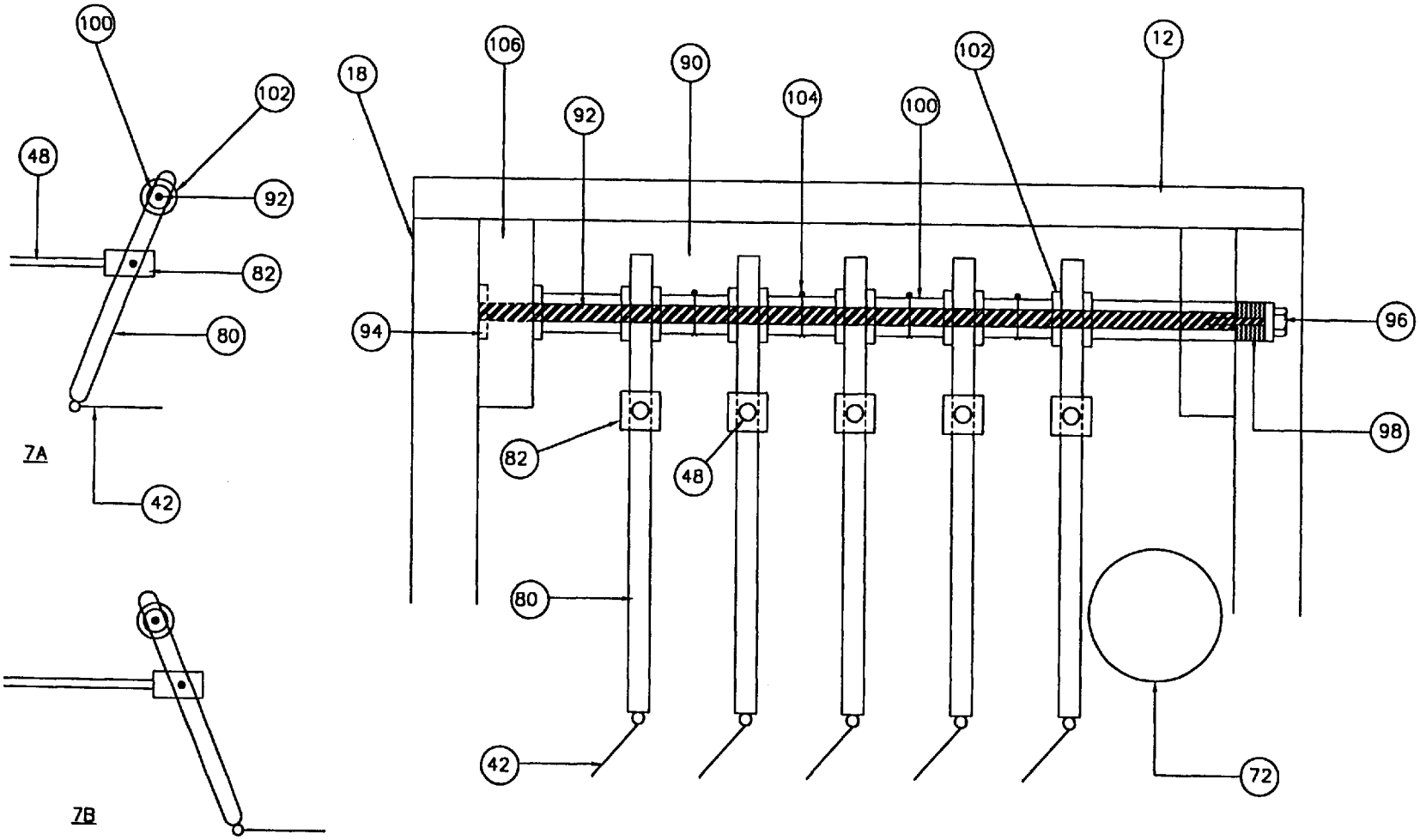
FIG. 7 is a cross-sectional view of an alternate pin reset mechanism.

As shown in FIG. 7, an alternative preferred embodiment incorporates a hinged lever (80) to shorten the distance the push/pull dowel (48) must travel as compared to the pin (20) when moving the pin (20) from the first to the second position. The push/pull dowel (48) is attached to a dowel clevis (82) which is attached approximately midway between the hinged end of the pin reset lever (80) and the end to which the pin cable (42) is attached. The force imparted by the push/pull dowel (48) on the pin cable (42) is multiplied by the lever (80). The result is the push/pull dowel (48) travels less distance than the pin (20) when resetting the pins.

In this alternative preferred embodiment, a mechanism (90) is used to align and control the pin reset levers (80). The shaft mechanism is comprised of a shaft (92) which acts as a hinge and runs through holes in the top of the pin reset levers (80) and is locked in place at one end by a spring pin (94). At the other end of the shaft (92) is a tension adjustment nut (96), when turned compresses the tension spring (98) which in turn puts tension on a series of spacer/collars (100), located between each pin reset lever (80), which tension ensures that when a push/pull dowel (48) is pulled and the pin (20) is in the raised position, the weight of the pin will not be sufficient to lower the pin back to the lane surface (12).

The shaft mechanism also comprises washers (102) and cotter pins (104) which prevent the spacers/collars (100) from moving and causing adjacent pin reset levers (80) to move when one pin reset lever (80) is engaged. Stabilizer blocks (106) are used to hold the shaft mechanism (90) in place and are attached to the main housing (18).

As will be apparent to those skilled in the art, various modifications, adaptations and variations of the foregoing specific disclosure can be made without departing from the teachings of the present invention. For example, the specific embodiments of the pin reset mechanism and the ball return mechanism described herein are not intended to be limiting of the invention claimed. A person skilled in the art may readily conceive of any number of alternative physical arrangements which accomplish the same effect as the specific structure disclosed herein.

What is claimed is:

1. A small scale replica bowling game having a player end and a pin end, said game comprising;

(a) a cabinet adapted to be supported by a stand or a plurality of legs;

(b) a flat lane surface abutted by a ball gutter on either side, said lane surface having an underside and mounted to the cabinet;

(c) an overhead pin housing continuous with the cabinet and disposed above the pin end of the lane;

(d) at least 5 bowling pins, each pin having a head and a base and each pin moveable between a lowered set position on the lane surface and a raised position above the lane surface; and (e) reset means contained within the cabinet and associated with each pin wherein the reset means is operable by the player at the player end to raise and lower each pin;

(f) wherein each reset means comprises an elongate rod slidably engaging the underside of the lane surface and a cable attached to one end of the rod and also attached to the pin head, each said rod moveable between an initial position wherein the cable has sufficient slack to permit the pin to fall and an extended position wherein the cable pulls the pin to its raised position, further wherein retraction of the rod to its initial position allows the pin to return to its lowered position by operation of gravity alone.

2. The bowling game of claim 1 further comprising a lever having a fixed hinged end and a cable end wherein the cable is attached between the cable end of the lever and the pin head and wherein the elongate rod engages the lever between the fixed end and the cable end.

3. The bowling game of claim 2 further comprising a lever shaft which engages the fixed end of the lever and tensioning means for adjusting the force necessary to raise or lower the pin, which tensioning means acts on the lever shaft.

4. The bowling game of claim 1 further comprising a plurality of cable guides for guiding each cable from the underside of the lane surface to the overhead pin housing.

5. The bowling game of claim 1 further comprising ball return means for returning a game ball to the player end of the game.

6. The bowling game of claim 5 wherein the ball return means is gravity-operated and comprises a ball collection ramp, a return tube and a return outlet, arranged such that the game ball is gathered by the ramp into the return tube and comes to rest in the return outlet at the player end of the game.

* * * * *